US010246307B1

(12) United States Patent
Baier

(10) Patent No.: US 10,246,307 B1
(45) Date of Patent: Apr. 2, 2019

(54) HARDTOP REMOVAL BRACKET AND METHODS OF USE THEREOF

(71) Applicant: Eric Andrew Baier, Oshkosh, WI (US)

(72) Inventor: Eric Andrew Baier, Oshkosh, WI (US)

( * ) Notice: Subject to any disclaimer, the term of this patent is extended or adjusted under 35 U.S.C. 154(b) by 275 days.

(21) Appl. No.: 15/246,782

(22) Filed: Aug. 25, 2016

Related U.S. Application Data

(60) Provisional application No. 62/211,542, filed on Aug. 28, 2015.

(51) Int. Cl.
*B66C 1/62* (2006.01)

(52) U.S. Cl.
CPC ..... *B66C 1/62* (2013.01)

(58) Field of Classification Search
CPC .... B66C 1/62; B66C 1/64; B66C 1/66; B66C 1/107; B66C 1/16; B66F 7/26; B60J 7/1664; B60J 7/1628; B60J 7/16
USPC ..... 294/82.1, 215, 67.1, 904; 254/47, 338; 414/626; 248/327; 296/103, 102, 146.8, 296/146.11, 107.07
See application file for complete search history.

(56) References Cited

U.S. PATENT DOCUMENTS 131,224 A * 9/1872 Paul ..... B62C 5/04 278/112
651,091 A * 6/1900 Williams ..... B66C 1/34 24/698.1
2,048,277 A * 7/1936 Mays ..... E21B 17/023 24/369
2,079,240 A * 5/1937 Bruns ..... B66C 1/14 294/82.13
2,552,758 A * 5/1951 Andersen ..... B66C 1/12 294/74
2,859,881 A 11/1958 Coryell
3,253,707 A * 5/1966 Gooding ..... B65D 71/0092 206/597
3,337,256 A * 8/1967 Shropshire, Jr. ..... B66C 1/127 24/372
4,120,189 A * 10/1978 Jones, Jr. ..... B21D 1/12 24/698.1
4,576,542 A 3/1986 Brasell et al.
(Continued)

FOREIGN PATENT DOCUMENTS

DE 3942551 6/1991
DE 29919828 U1 * 4/2000 ..... B66C 1/66
(Continued)

OTHER PUBLICATIONS jeepforum.com, as viewed at: http://www.jeepforum.com/forum/f96/rear-glass-hinges-hoist-attachment-point-1473190/.

*Primary Examiner* — Gabriela M Puig
(74) *Attorney, Agent, or Firm* — Brannen Law Office, LLC

(57) ABSTRACT

Brackets having a base and an arm. The base can be connected to a rear window hinge support of a hardtop with the hinge bolts used to secure a rear window hinge. The base has slots that provide for an increased flexibility of bolt patterns or widths. The top of the slots are open with necks to allow for easy insertion and removal of the brackets without removal of the rear window and allows the brackets to be used with multiple models. The base has a central void. An arm having an eye upstands from the base. A relief is provided at the area where the arm is connected to the base. Two brackets (a left and a right bracket) are secured to a hardtop before use. A hoist or lift can connect to the eyes to facilitate removal and storage of the hardtop.

14 Claims, 10 Drawing Sheets

(56) References Cited

U.S. PATENT DOCUMENTS

| | | | | |
|---|---|---|---|---|
| 4,600,177 | A | 7/1986 | Fritz | |
| 4,763,943 | A * | 8/1988 | Melvin | B63B 23/40 114/365 |
| 5,263,687 | A | 11/1993 | Garbiso | |
| 5,492,385 | A | 2/1996 | Champion | |
| 5,887,922 | A * | 3/1999 | Hendrix | B66C 1/62 294/67.5 |
| 5,897,104 | A | 4/1999 | Garbiso | |
| 6,003,936 | A | 12/1999 | Gordon | |
| 6,152,427 | A | 11/2000 | Hoslett | |
| 6,386,515 | B1 | 5/2002 | Sachtleben | |
| 6,428,069 | B1 * | 8/2002 | Simonson, Jr. | B66F 9/19 294/82.1 |
| 7,568,678 | B2 | 8/2009 | Hammond | |
| 8,408,623 | B1 | 4/2013 | McAuliff | |
| 2003/0184106 | A1 | 10/2003 | Windecker | |
| 2009/0095860 | A1 * | 4/2009 | Yoon | B66C 1/10 248/225.11 |
| 2009/0309079 | A1 | 12/2009 | Lacina | |
| 2010/0078950 | A1 * | 4/2010 | Inda | B66C 1/66 294/215 |
| 2011/0285156 | A1 * | 11/2011 | Kaybidge | B66C 1/10 294/82.1 |
| 2013/0015218 | A1 | 1/2013 | Surkin | |
| 2013/0199110 | A1 * | 8/2013 | Sias | B66C 1/62 52/125.2 |
| 2013/0280020 | A1 | 10/2013 | O'Brien et al. | |
| 2014/0138983 | A1 | 5/2014 | Haberkamp et al. | |
| 2014/0327261 | A1 * | 11/2014 | Okawa | B66C 1/66 294/215 |

FOREIGN PATENT DOCUMENTS

| | | | | |
|---|---|---|---|---|
| DE | 102005024057 | | 12/2005 | |
| DE | 102010009368 | A1 * | 9/2010 | B66C 1/14 |
| WO | WO-2013149321 | A1 * | 10/2013 | B66C 1/62 |
| WO | WO-2014172748 | A1 * | 10/2014 | B66C 1/62 |

* cited by examiner

FIG. 1
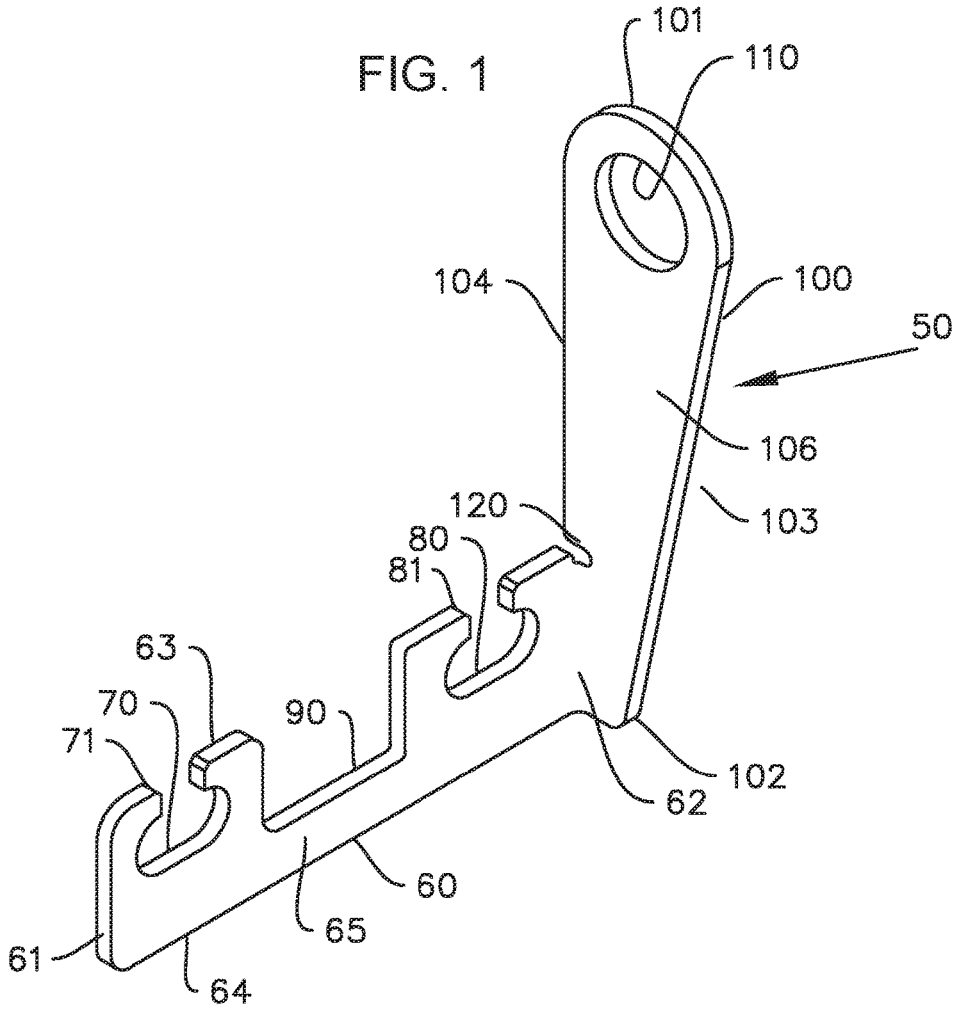
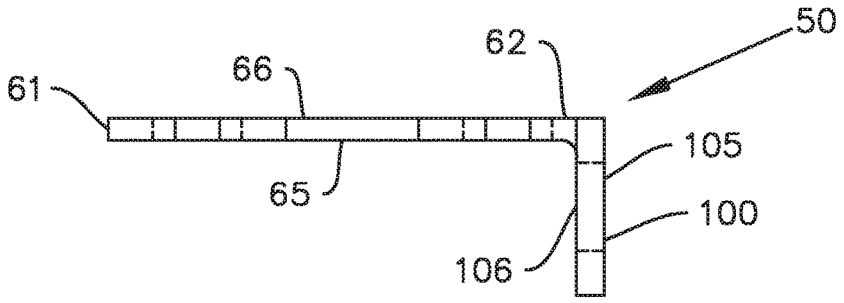
FIG. 2

FIG. 3
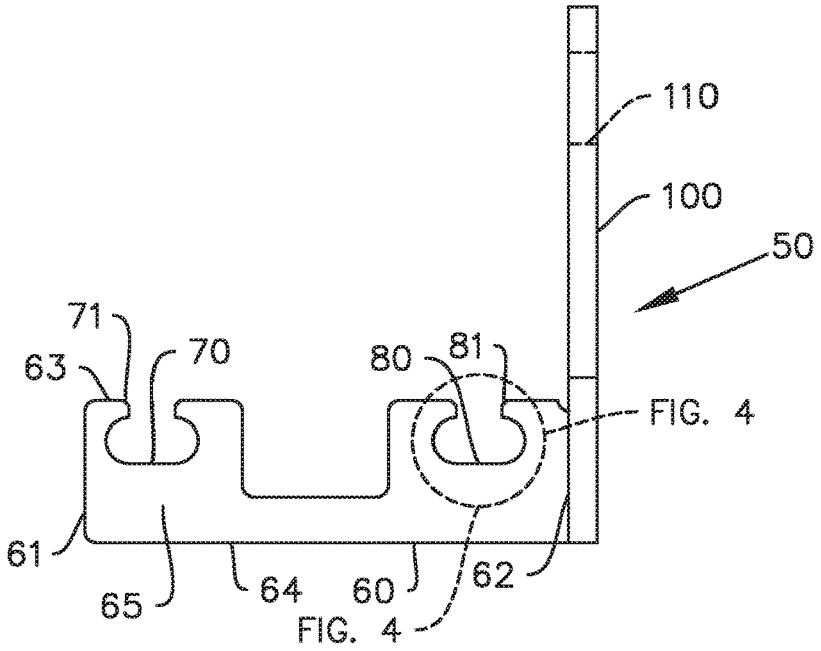
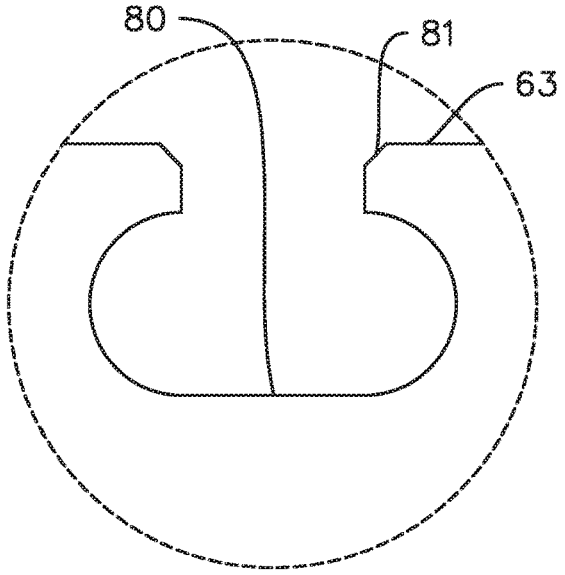
FIG. 4

HARDTOP REMOVAL BRACKET AND METHODS OF USE THEREOF

This United States utility patent application claims priority on and the benefit of provisional application 62/211,542 filed Aug. 28, 2015, the entire contents of which are hereby incorporated herein by reference.

BACKGROUND OF THE INVENTION

1. Field of the Invention

The present invention relates to a hardtop removal bracket and to the methods of use thereof and in particular to a bracket attaching to or integrated with a window hinge.

2. Description of the Related Art

Many vehicles make use of removable hard tops. One such vehicle is made by Jeep. While this particular type of vehicle is described as an example, there are many other vehicles that have removable hardtops.

Over the years, there have been many attempts to facilitate the removal of hardtops. Some examples include:

U.S. Pat. No. 4,576,542 to Brasell et al. is titled Device for Lifting Removable Automobile Tops.

U.S. Pat. No. 4,600,177 to Fritz is titled Method of Hoisting an Automobile Hard Top.

U.S. Pat. No. 5,263,687 to Garbiso is titled Automobile Hardtop Storage Apparatus.

U.S. Pat. No. 5,492,385 to Champion is titled Automobile Roof Harness.

U.S. Pat. No. 5,897,104 to Garbiso is titled Overhead Hoist and Sling Apparatus for Removing, Storing and Replacing a Removable Automobile Hardtop.

U.S. Pat. No. 6,003,936 to Gordon is titled Sport-Utility Vehicle Top.

U.S. Pat. No. 6,152,427 to Hoslett is titled Truck Cap Hoisting System.

U.S. Pat. No. 6,386,515 to Sachtleben is titled Device to Install/Remove Truck Cap.

U.S. Pat. No. 7,568,678 to Hammond is titled Apparatus for Removing and Reinstalling the Hardtop of an Automobile.

U.S. Pat. No. 8,408,623 to McAuliff is titled Vehicle with Multiple Elevation Removable Hard Top and Secure Storage Underneath.

United States Patent Application Publication 2003/0184106 to Windecker is titled Vehicular hardtop Lifting Yoke.

United States Patent Application Publication 2009/0309079 to Lacina is titled Jeep Hard-Top Remover.

United States Patent Application Publication to Surkin is titled Apparatus for Connecting a Carrier to a Hardtop.

United States Patent Application Publication 2013/0280020 to O'Brien et al. is titled Hard Top Removal Hitch Attachment.

United States Patent Application Publication 2014/0138983 to Haberkamp et al. is titled Composite Soft Top Assembly for SUV, Both 2 and 4 Door.

While the products shown in each of these publications may work well for their intended purposes, none show the unique advantages of the present invention.

Thus there exists a need for a hardtop removal bracket and to the methods of use thereof that solves these and other problems.

SUMMARY OF THE INVENTION

The present invention includes brackets having a base and an arm. The base can be connected to a rear window hinge support of a hardtop with the hinge bolts used to secure a rear window hinge. The base has slots that provide for an increased flexibility of bolt patterns or widths. The top of the slots are open with necks to allow for easy insertion and removal of the brackets without removal of the rear window and allows the brackets to be used with multiple models. The base has a central void. An arm having an eye upstands from the base. A relief is provided at the area where the arm is connected to the base. Two brackets (a left and a right bracket) are secured to a hardtop before use. A hoist or lift can connect to the eyes to facilitate removal and storage of the hardtop.

According to one advantage of the present invention, a bracket is provided for use in removing a hardtop from a vehicle. Two brackets (either two of the same or a dedicated left and right bracket—mirror images of each other) can be used and are connected immediately adjacent the two hinges of the rear window. The brackets can be connected to the hinge mounts outside of the existing hinge hardware. These mounts are structurally strong and are already present on the hardtops. This allows the present invention to be used without making any additional holes or other modifications to the hardtop.

According to another advantage of the present invention, oval slots are provided to advantageously increase flexibility or range of widths that the present invention can be used with. Related, the slots have a neck at the top (open top) to allow the brackets to be inserted adjacent the hinge without full removal of the hinge bolts and while the window remains in place attached to the shell. The bottoms of the slots are solid and continuous wherein the weight of the hardtop is fully supported when hoisted or lifted and stored. Still further, the slots allow for the brackets to be adjusted laterally relative to the bolts, thereby allowing the lateral location of the arms to be tailored to the desired location relative to the hinges and window.

According to a further advantage of the present invention, two brackets are used resulting in laterally equal rear weight distribution of the hardtop as it is being removed and stored. This is accomplished by using a bracket to form rigid connections at each hinge location. It is appreciated that the present invention can also be used in combination with conventional front end lifting mechanisms.

Related, the brackets are fixed in relation to the hardtop thereby preventing shifting or sliding of the hardtop relative to a hoist or harness during lifting and storage.

According to a still further advantage of the present invention, the brackets are unobtrusive. In this regard, they extend beyond the hardtop a minimal amount and can be left in place when not in use. The unobtrusiveness is achieved as reliefs are present thereby allowing the arm to be bent relative the base in a manner to reduce offset of the eye center relative to the plane of the body.

According to a still further advantage of the present invention, a clearance or void can be provided in the center or middle of the bracket base. This allows for clearance with some hinges that have protruding structures between the bolt holes.

According to a still further advantage yet of the present invention, the brackets are operable and readily accessible by a user regardless of whether the window is open or closed. Further, the window freely opens and closes with the brackets in place.

According to a still further advantage yet of the present invention, use of the brackets causes no interference with or damage to the vehicle or hardtop weather-stripping. Related, the bracket eyes extend behind the hardtop allowing for a hoist or lift to fully clear the hardtop without causing damage thereto.

According to a still further advantage yet of the present invention, the brackets can be used with any type of hard top hoist or lift.

According to a still further advantage yet of the present invention, the hardtop can be removed by a single individual.

According to other embodiments of the present invention, the eye can be integrated into a hinge. In this regard, the integrated hinge can replace the original hinge in both OEM and aftermarket situations.

Other advantages, benefits, and features of the present invention will become apparent to those skilled in the art upon reading the detailed description of the invention and studying the drawings.

BRIEF DESCRIPTION OF THE DRAWINGS

FIG. 1 is a perspective view of a preferred bracket of the present invention.

FIG. 2 is a top view of the bracket illustrated in FIG. 1.

FIG. 3 is a side view of the bracket illustrated in FIG. 1.

FIG. 4 is a close up view taken along circle 4 in FIG. 3.

DETAILED DESCRIPTION OF PREFERRED EMBODIMENTS

Figure 5:
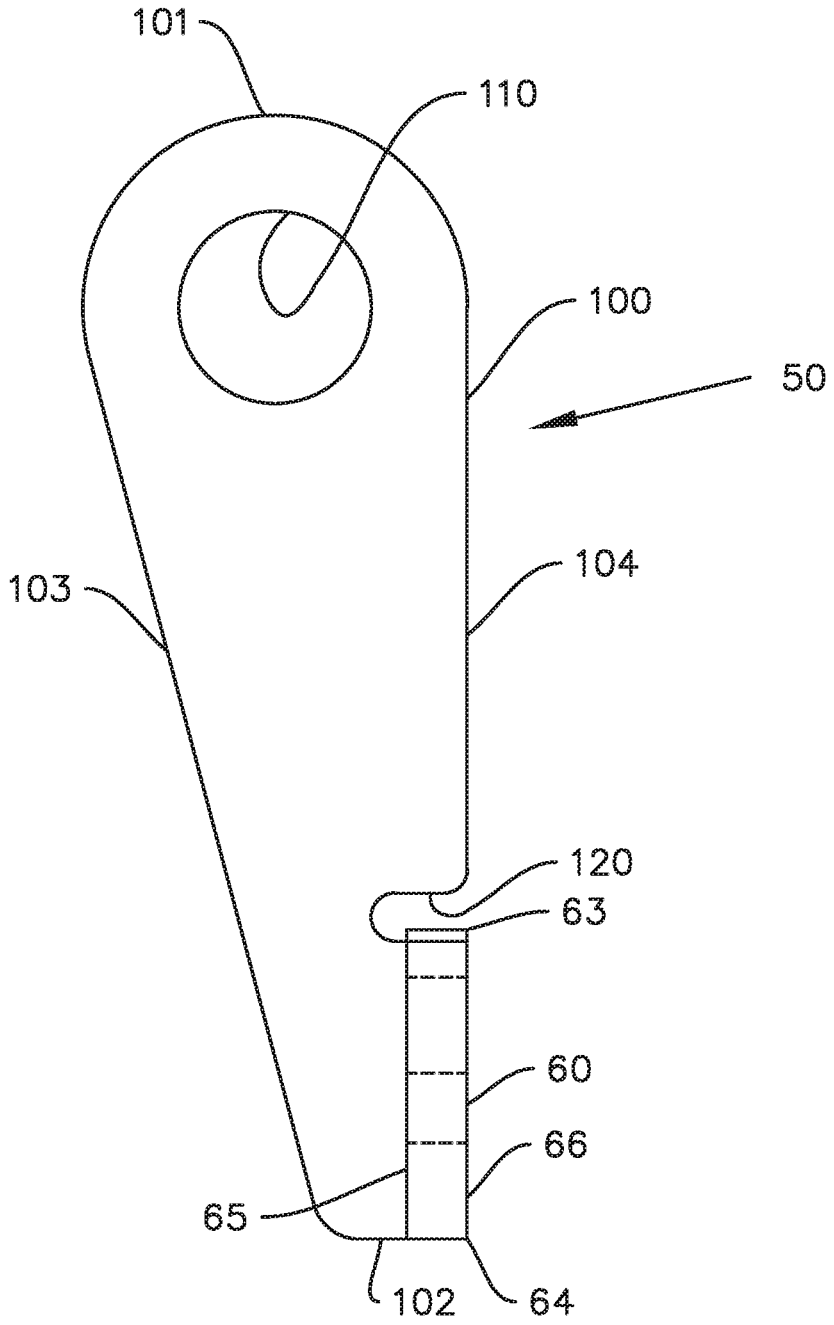
FIG. 5 is an end view of the bracket illustrated in FIG. 1.

While the invention will be described in connection with one or more preferred embodiments, it will be understood that it is not intended to limit the invention to those embodiments. On the contrary, it is intended to cover all alternatives, modifications and equivalents as may be included within the spirit and scope of the invention as defined by the appended claims.

The present invention is useful for use with a vehicle 5 having a body 10 with a removable hardtop 20. One exemplary vehicle is made by Jeep. However, the present invention is suitable for use with other vehicles as well.

The hardtop 20 has a shell 30 having a front and a rear 32. Two hinge supports 33 each comprising two holes 34 (four holes total) is provided in the rear 32 of the shell. A window 40 is pivotally connected to the shell 30 with hinges 45. Four hinge bolts 46 are used to secure the hinges 45 to the shell via insertion into the hinge holes 34. The structure of the shell at the hinge holes 34 is strong as it is designed to withstand the stress of the use of the hinges.

Turning now to FIGS. 1-5, it is seen that a bracket 50 is provided. The bracket 50 is preferably made of a strong material such as metal. However, other materials may be used without departing from the broad aspects of the present invention.

The bracket 50 has a base 60 having a first end 61, a second end 62, a top 63, a bottom 64, a first side 65 and a second side 66. The base 60 or body is preferably generally planar and lies in a base plane. Two holes 70 and 80 pass through the base 60. Necks 71 and 81, respectively, are further provided. The holes 70 and 80 are each preferably generally slot shaped in that they are longer than they are tall. Each slot has a longitudinal and a through axis. The through axis of each slot is parallel to each other, respectively. While linearly oriented slots are shown, it is appreciated that slots with other orientations or shapes could be used without departing from the broad aspects of the present invention. The necks are at the top 63 of the base and provide an opening into the respective holes 70 and 80. The necks are preferably relieved to avoid sharp edges. Also, the relieved necks facilitate insertion of the bolts through the necks, in particular in situations where visual guidance is impaired by the head of the bolt. The necks are preferably generally centrally aligned relative to the respective slots. This allows for maximum flexibility in placing the bolts through the necks.

The bracket 50 can be laterally moved relative to the bolts, and is constrained by the ends of the slots. This allows the bracket to be laterally adjusted as necessary for clearance reasons.

A central void 90 is also provided. The void 90 provides clearance for some applications wherein hardtop hinges protrude outwards between the hinge bolts.

Figure 10:
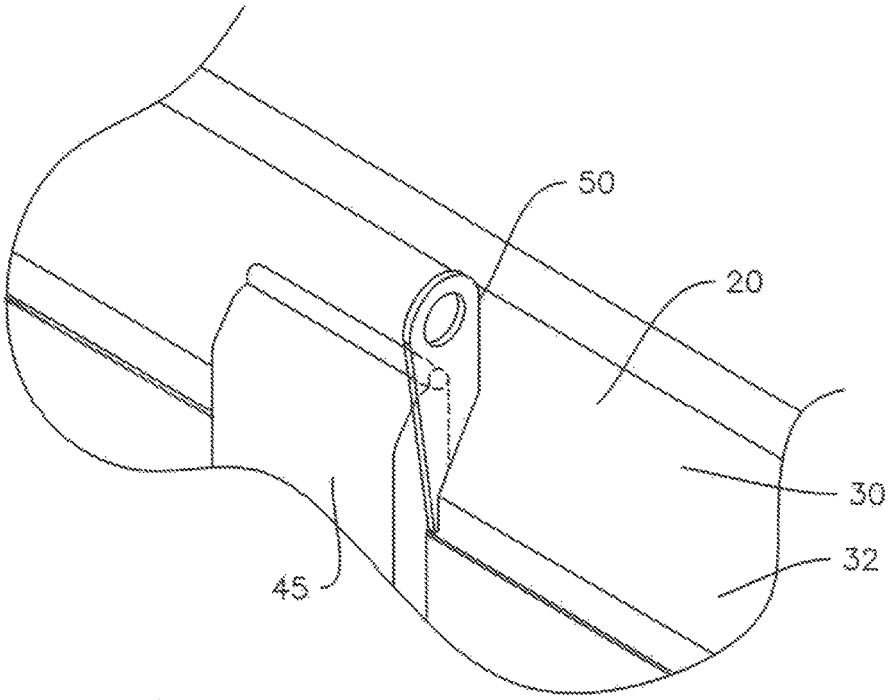
FIG. 10 is a figure showing the bracket extending from a hardtop with a window in a closed position.
Figure 11:
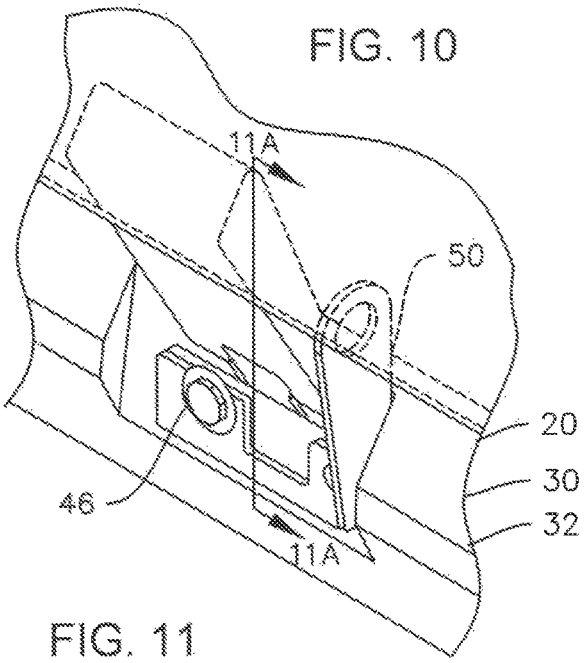
FIG. 11 is a figure showing the bracket extending from a hardtop with a window in an open position.
Figure 11A:
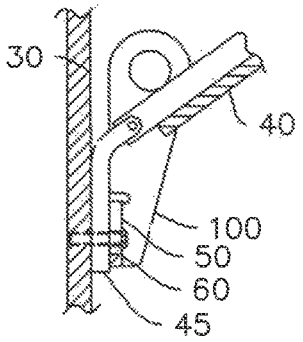
FIG. 11A is a cross-sectional view taken along line 11A-11A in FIG. 11.
Figure 12:
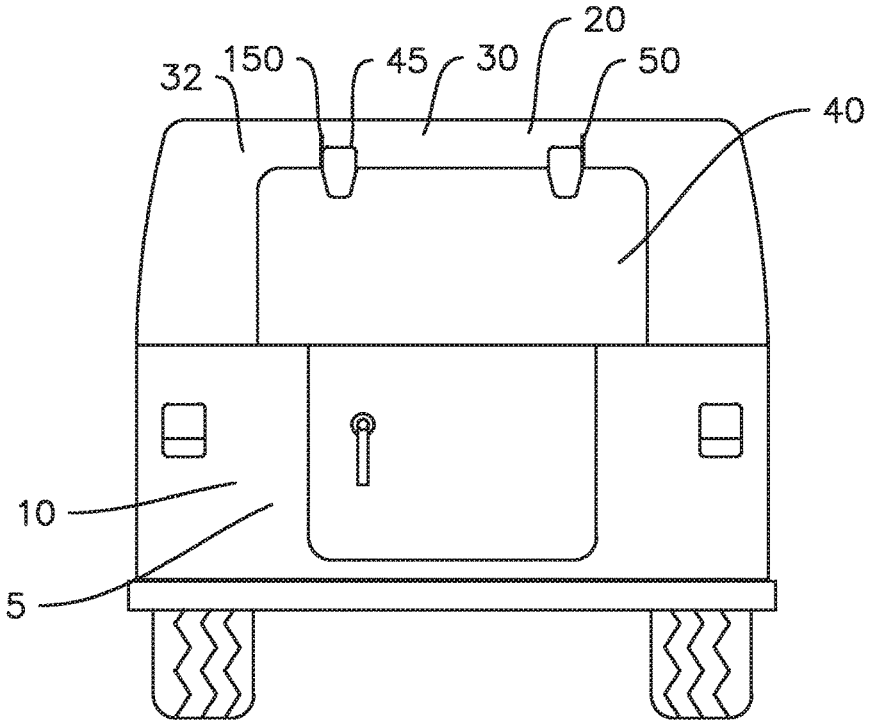
FIG. 12 is a figure showing two brackets (left and right which are mirror images of each other) with a window in the closed position.
Figure 13:
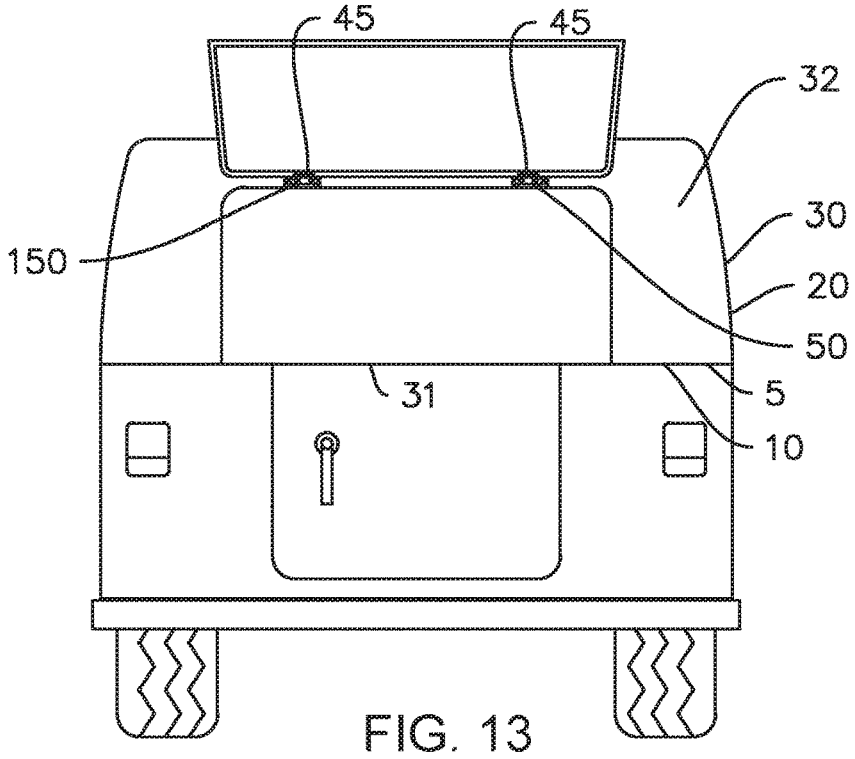
FIG. 13 is similar to FIG. 12 but shows the window in the open position.

The bracket 50 further has an arm 100 upstanding from the base 60. The arm 100 has a top end 101 (distal end), a bottom end 102 (proximal end), a forward edge 103, a rearward edge 104, a first side 105 and a second side 106. The arm lies in an arm plane. The arm plane is generally perpendicular to the base plane. An eye 110 passes through the arm 100 adjacent the top end 101 between the sides. As seen in FIG. 10, this allows the eye to be accessible when the rear window is closed. The eye (or eyelet) is preferably generally round. The rearward edge 104 is preferably vertically oriented. The forward edge is vertically divergent from the rearward edge. The top end 101 is generally round so as to reduce the chance of an object getting snared or trapped on the bracket. While an eye is illustrated, it is appreciated that other structures or connectors could be used without departing from the broad aspects of the present invention.

A relief 120 is further provided. The relief allows for the manufacturability of the bracket wherein the arm can be folded in a manner minimizing or eliminating the offset of the rearward edge 104 relative to the back side 66 of the base 60. In a preferred embodiment, the rearward edge 104 generally lies in or near the same plane as the back side 66 of the base 60.

The base 60 has a longitudinal axis. The eye has an eye axis that is generally parallel to (albeit offset from) the base longitudinal axis. The base has a plane that is preferably generally perpendicular to a plane of the arm.

Figure 6:
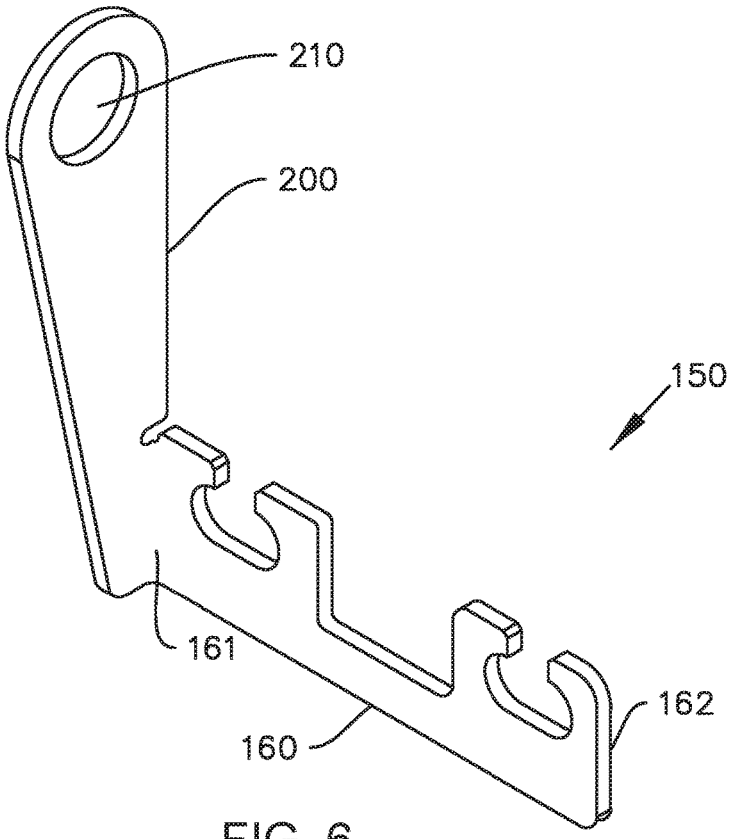
FIG. 6 is a perspective view of an oppositely oriented bracket.
Figure 7:
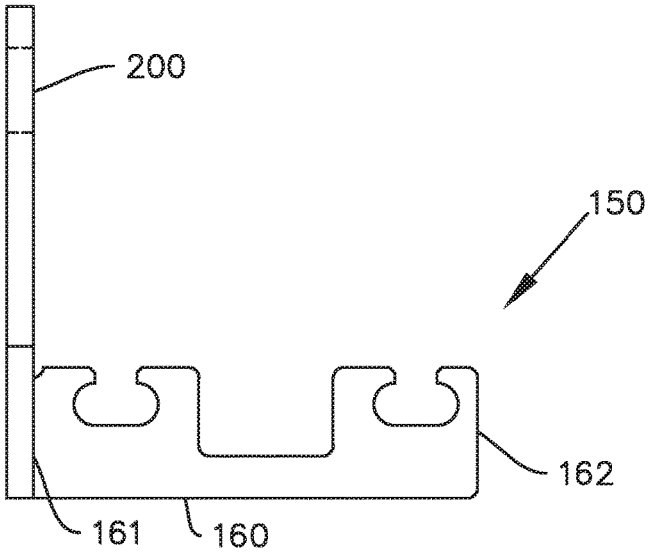
FIG. 7 is a side view of the bracket illustrated in FIG. 6.
Figure 8:
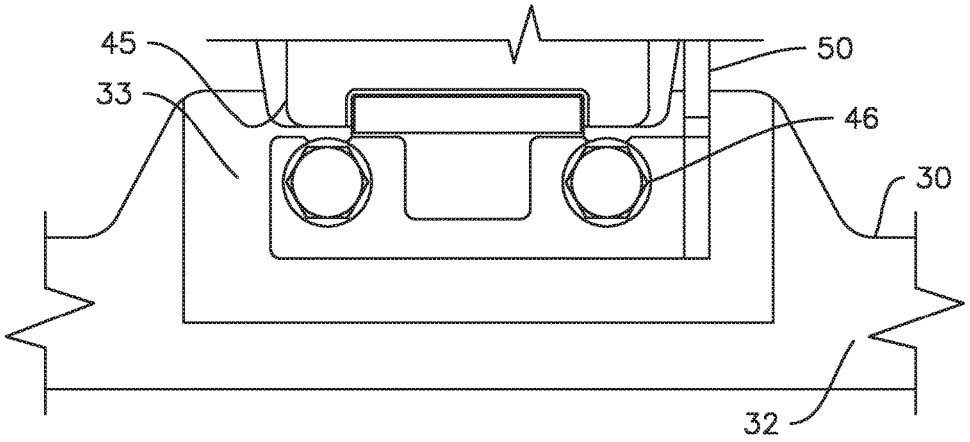
FIG. 8 is figure showing a bracket connected to a hinge support.
Figure 9:
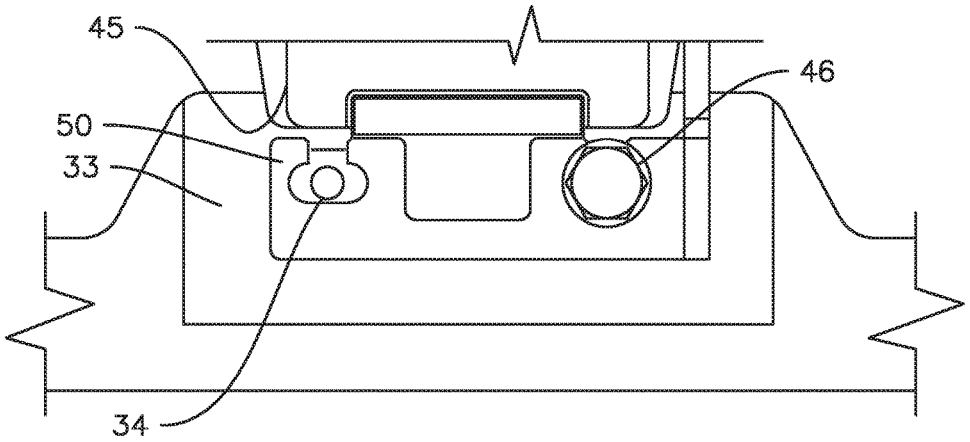
FIG. 9 is similar to FIG. 8 but shows one bolt removed exposing a hinge hole.

Turning now to FIGS. 6 and 7, it is seen that a second bracket 150 is shown. The bracket 150 is a mirror image structurally compared to bracket 50. Bracket 150 has a base 160 with ends 161 and 162. Bracket 150 further has an arm 200 with an eye 210 that upstands from the base.

In use, it is preferred that one of each of brackets 50 and 150 are used to ensure equal weight distribution. However, even if two of the same brackets are used on the left and right side of the hardtop, a quasi-equal weight distribution will still be present at the rear of the hard top.

Use of the present invention is illustrated in FIGS. 8-14. It is seen that brackets 50 and 150 can be used to connect to the hardtop 20. Looking now in particular at FIGS. 8 and 9, it is seen how the hinge bolts 46 secure the bracket 50 to the hardtop 20 at the hinge location outside of the existing hinge hardware. The bracket can be installed by simply loosing and partially unthreading the bolts 46 and then passing the bracket 50 upwards so that the shaft of the bolt passes through the neck wherein it is received in the respective slot. The bracket is then adjusted laterally as necessary for the arm to clear the hinge, and the bolt is then tightened down. Each of the four bolts can be loosened and retightened when the respective brackets are in place. The forward edge of the arm is oriented away from the base piece of the hinge. It is seen that the bracket remains stationary regardless of the position of the window relative to the shell.

The weight of the shell is transferred through the bolts to the brackets, wherein it is then supported by a harness or hoist 47.

Figure 14:
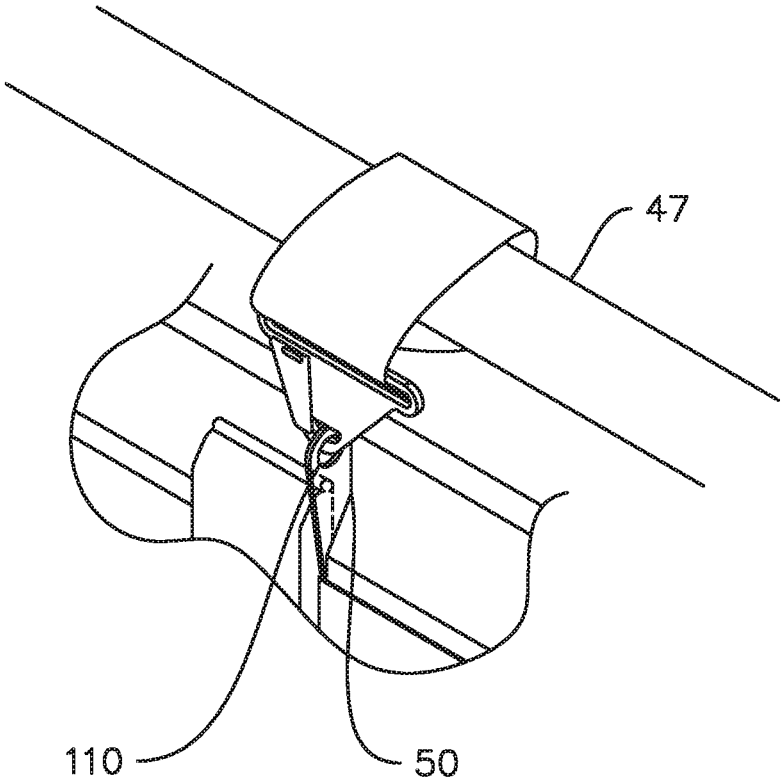
FIG. 14 is a view showing a harness connected to the bracket to facilitate removal of the hardtop.

The harness or hoist 47 can connect to the eye as seen in FIG. 14 as an attachment point. In this regard, the harness is securely connected to an eye that is stationary relative to the hardtop, thereby preventing the harness or hoist from being able to slip or slide off of the hardtop. It is appreciated that the necks are open to the top of the base. In this regard, the weight of the removable top can be supported by the bottom of the slots when the harness lifts the top from the vehicle.

A front strap can be used to hoist the front of the hardtop in a conventional manner.

The window opens and closes with the brackets in place. This is possible as the arm lies in a plane that is parallel to a swing plane of the hinge (and perpendicular to the axis of rotation of the hinge). Therefore, the bracket does not interfere with the swinging of the hinge and window.

Figure 15:
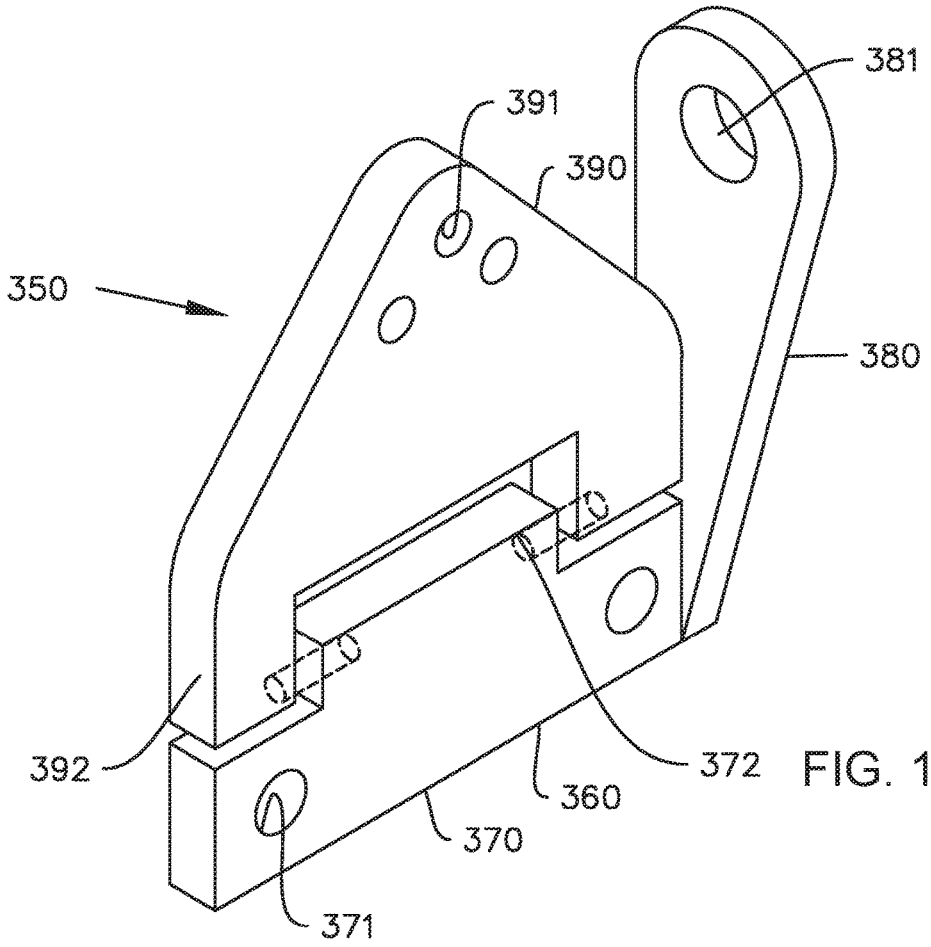
FIG. 15 is a perspective view of an integrated hinge and bracket.
Figure 16:
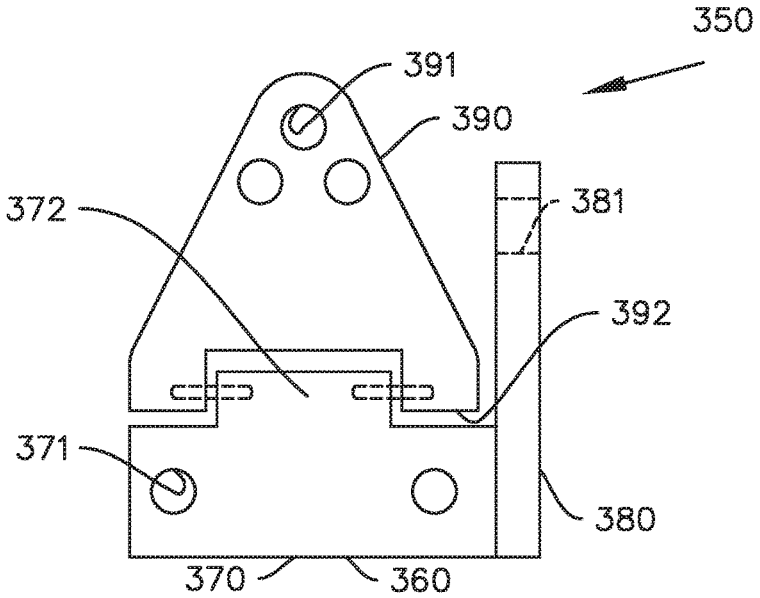
FIG. 16 is a side view of the embodiment illustrated in FIG. 15.

Turning now to FIGS. 15 and 16, it is seen that an alternative embodiment is illustrated of an integrated hinge and bracket 350. The integrated piece 350 has a first piece 360 with a base 370 having bolt holes 371 there through and an arm 380 with an eye 381 upstanding from the base 370. A second piece 390 with glass connecting holes 391 is pivotally connected to the first piece. In this embodiment, it is noted that the eye is supportable by the hinges holes of the hardtop with bolts. The first piece has a pivot 372 that is pivotally connected to a pivot 392 of a second piece.

Figure 17:
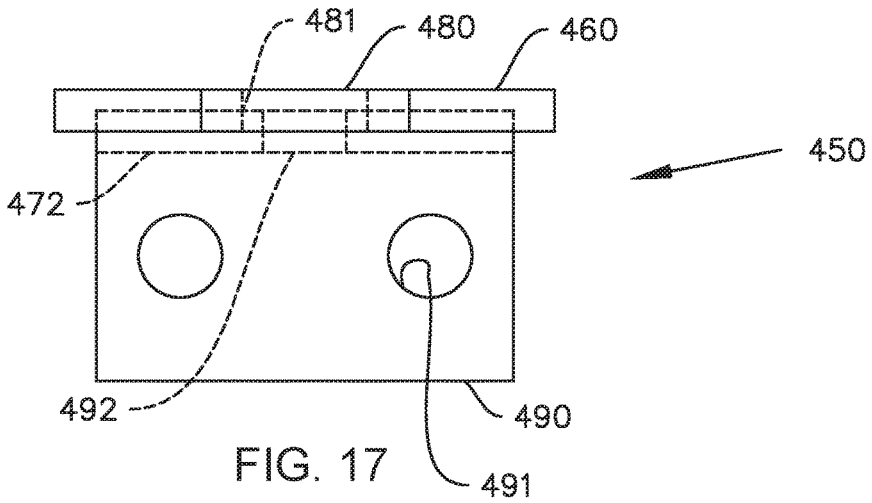
FIG. 17 is a top view of a further alternative embodiment of the present invention.
Figure 18:
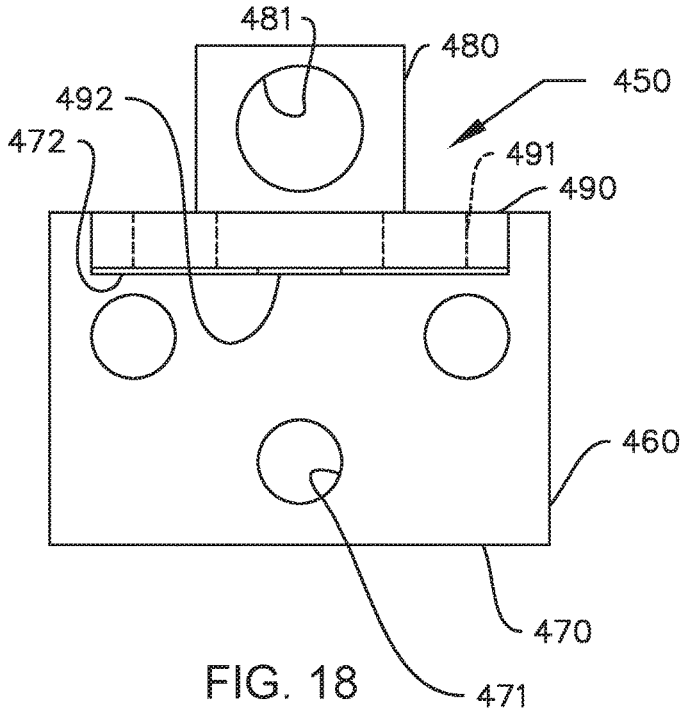
FIG. 18 is a front view of the embodiment illustrated in FIG. 17.
Figure 19:
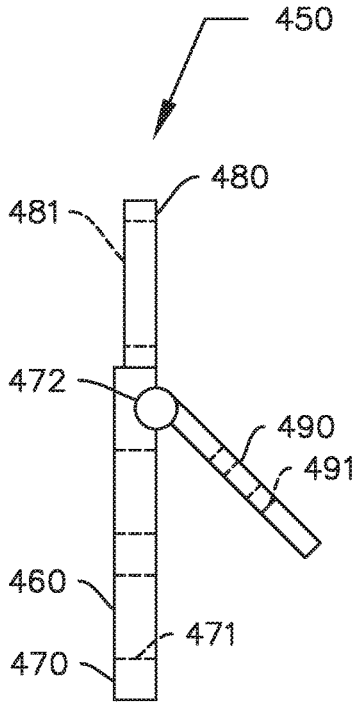
FIG. 19 is a side view of the embodiment illustrated in FIG. 17 with the second piece in an alternative pivotal location with respect to the first piece.

Turning now to FIGS. 17-19, it is seen that a further alternative embodiment is illustrated of an integrated hinge and bracket 450. The integrated piece 450 has a first piece 460 with a base 470 having bolt holes 471 there through and an arm 480 with an eye 481 upstanding from the base 470. A second piece 490 with glass connecting holes 491 is pivotally connected to the first piece. In this embodiment, it is noted that the eye is supportable by the hinges holes of the hardtop with bolts. The first piece has a pivot 472 that is pivotally connected to a pivot 492 of a second piece.

It is appreciated that integrated hinges with eyes are useful as both OEM and aftermarket replacements to traditional hinges. The integrated hinges serve the functions of the OEM hinges with the additional benefit of having eyes for use with hoists.

Thus it is apparent that there has been provided, in accordance with the invention, a hardtop removal bracket and to the methods of use thereof that fully satisfies the objects, aims and advantages as set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A device comprising:

a base; and an arm with an eye;

wherein said base has a first hole there through; said base has a second hole there through; wherein said first hole has a first hole neck; said second hole has a second hole neck; wherein said first hole neck has a first hole neck width; said first hole has a first hole width; said first hole width is larger than said first hole neck width; wherein said first hole is generally slot shaped and has a first hole through axis; said second hole is generally slot shaped and has a second hole through axis; wherein said eye has an eye axis; said first hole through axis is generally parallel to said second hole through axis; and said eye axis is generally perpendicular to said first hole through axis and to said second hole through axis.

2. The device of claim 1 wherein said base has a perimeter and said neck is open to said perimeter.

3. The device of claim 2 wherein said neck is open to said perimeter in a direction towards said eye.

4. The device of claim 1 wherein said device has a central void between said first hole and said second hole.

5. The device of claim 1 wherein said eye is integral with said base.

6. The device of claim 5 wherein:

said base lies in a base plane;

said arm lies in an arm plane; and said arm plane is generally perpendicular to said base plane.

7. The device of claim 6 wherein said eye is offset from said base plane.

8. The device of claim 7 wherein said arm has a distal end and a proximal end, said eye being located at said distal end of said arm.

9. A bracket useful to remove a hardtop having a hinge connection, said bracket comprising:

a base connectable to the hinge connection; and an arm with an eye;

wherein said base has a first hole there through; said base has a second hole there through; wherein said first hole has a first hole neck; said second hole has a second hole neck; wherein said first hole neck has a first hole neck width; said first hole has a first hole width; said first hole width is larger than said first hole neck width; wherein said first hole is generally slot shaped and has a first hole through axis; said second hole is generally slot shaped and has a second hole through axis; wherein said eye has an eye axis; said first hole through axis is generally parallel to said second hole through axis; and said eye axis is generally perpendicular to said first hole through axis and to said second hole through axis.

10. The bracket of claim 9 wherein:

said base lies in a base plane; and said base plane is generally parallel to said eye axis.

11. The bracket of claim 10 wherein:

said eye is offset from said base plane;

said base has a base perimeter;

and wherein said first hole neck and said second hole neck are open to said base perimeter.

12. A method comprising the steps:

providing a vehicle with a removable top having a hinge support and a pivotable member that is connected to the removable top at the hinge support;

providing a bracket having an eye;

securing the bracket to the hinge support;

providing a harness;

securing the harness to the eye; and removing the removable top from the vehicle.

13. The method of claim 12 wherein the step of providing a bracket having an eye further comprises the step of providing the bracket wherein the eye has an eye axis that is generally parallel to a base plane of a base, the base being connected to the hinge support.

14. The method of claim 13 wherein the step of providing a bracket having an eye further comprises the step of providing the bracket wherein the eye is offset from the base and the base has holes there through each with necks open to a base perimeter.

* * * * *